US006739098B2

(12) United States Patent
Hoberman

(10) Patent No.: US 6,739,098 B2
(45) Date of Patent: May 25, 2004

(54) RETRACTABLE STRUCTURES COMPRISED OF INTERLINKED PANELS

(76) Inventor: Charles Hoberman, 472 Greenwich St., New York, NY (US) 10013

( * ) Notice: Subject to any disclaimer, the term of this patent is extended or adjusted under 35 U.S.C. 154(b) by 56 days.

(21) Appl. No.: 10/219,226

(22) Filed: Aug. 15, 2002

(65) Prior Publication Data

US 2003/0037491 A1 Feb. 27, 2003

Related U.S. Application Data

(60) Provisional application No. 60/314,774, filed on Aug. 24, 2001.

(51) Int. Cl.[7] ..... E04H 15/44

(52) U.S. Cl. ..... 52/109; 52/71; 52/641; 52/645; 52/80.1; 135/131; 135/145

(58) Field of Search ..... 52/80.1, 80.2, 52/81.1, 86, 109, 71, 641, 645, 646; 135/131, 145

(56) References Cited

U.S. PATENT DOCUMENTS 3,375,624 A * 4/1968 Mikulin ..... 52/109
3,672,104 A * 6/1972 Luckey ..... 52/109
4,194,327 A * 3/1980 Simone ..... 52/86
4,637,192 A * 1/1987 Brown ..... 52/632
4,651,589 A * 3/1987 Lambert ..... 74/469
4,942,700 A * 7/1990 Hoberman ..... 52/81.2
5,024,031 A * 6/1991 Hoberman ..... 52/81.2
5,651,228 A * 7/1997 Zeigler ..... 52/646
6,082,056 A * 7/2000 Hoberman ..... 52/81.5
6,219,974 B1 * 4/2001 Hoberman ..... 52/81.5

* cited by examiner

*Primary Examiner*—Brian E. Glessner

(57) ABSTRACT

This invention discloses tongs-linkage, which, in its extended position, provides an essentially triangular-shaped surface, whereby the links of the tongs-linkage are themselves the panels that form the surface. Such assemblies may be planar, or, by use of intermediate hub elements, may form a surface with curvature. As such an assembly is compressed, the panel-links slide over one another, compressing down to a compact stack. Such tongs-linkages may be joined to similar linkages by pivots lying along their respective edges thereby forming extended structural surfaces. Surfaces that are planar, cone-shaped and doubly-curved surfaces of revolution are disclosed. In each case when the structure is retracted it compresses down to a compact linear element or ring.

9 Claims, 9 Drawing Sheets

20
4
10
14
2
6
8
12
16
26
25
24
23
22
21
5
7
9

20
27
28
30
32
34
36
38
40
42
44
46
48
50
52
54
60

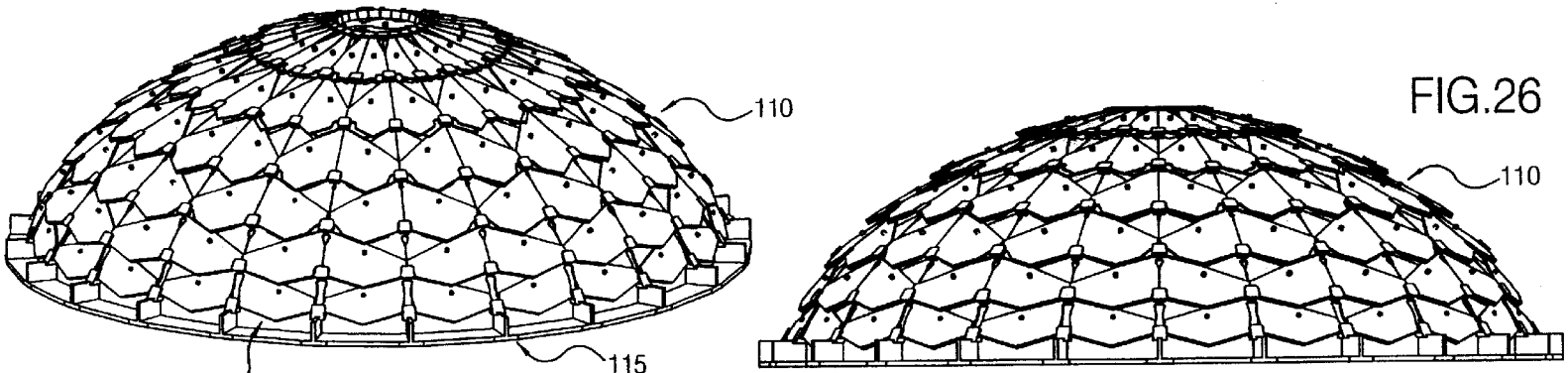
FIG.25
FIG.26
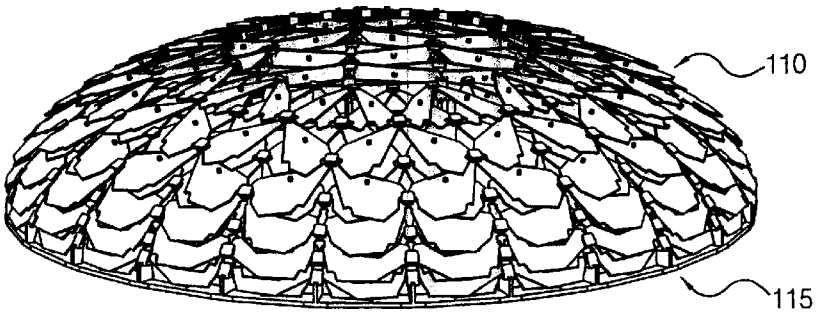
FIG.27
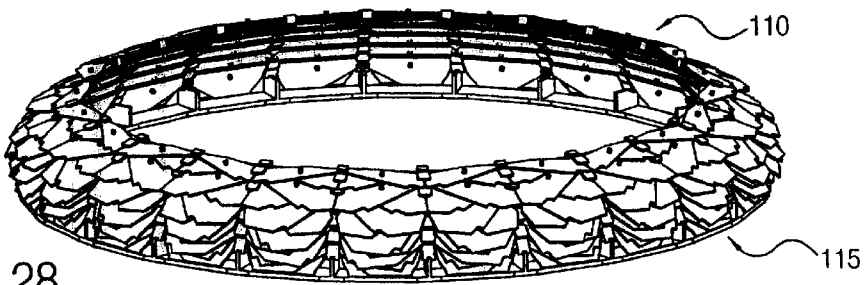
FIG.28

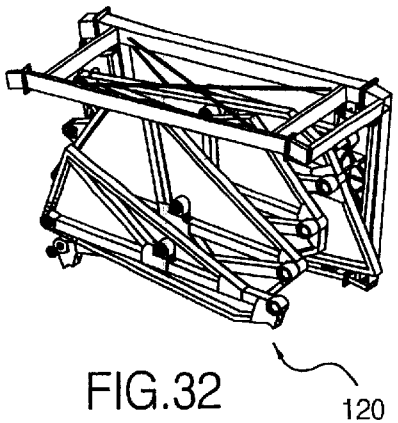
FIG.32
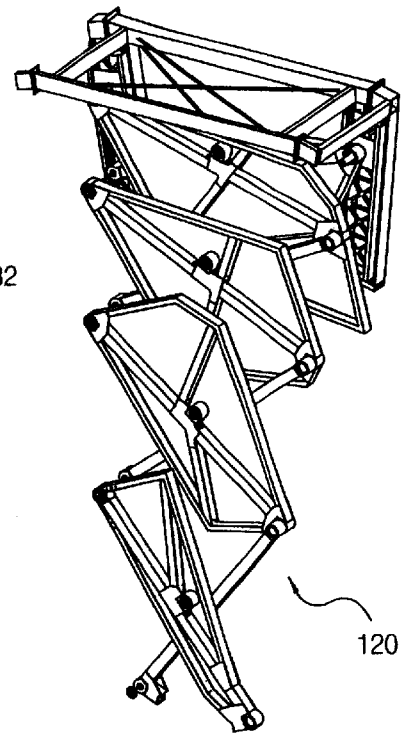
FIG.31
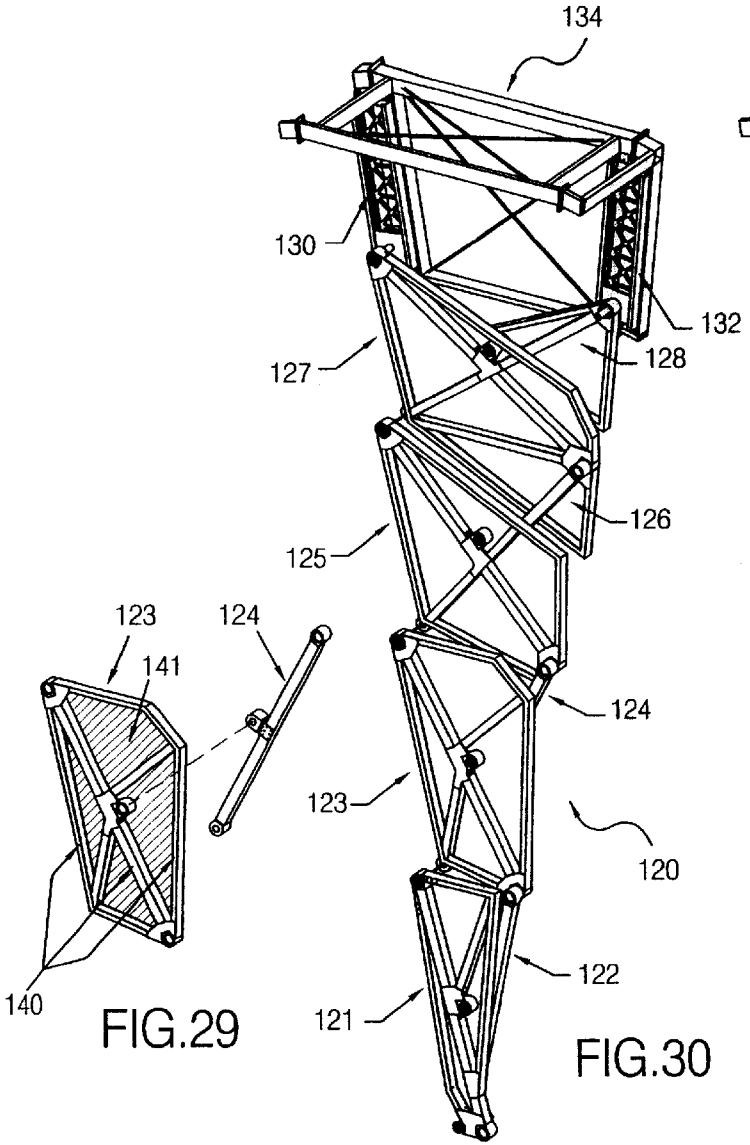
FIG.30
FIG.29

RETRACTABLE STRUCTURES COMPRISED OF INTERLINKED PANELS

RELATED APPLICATIONS

This application is based on Provisional Application Ser. No. 60/314,744 filed on Aug. 24, 2001, entitled "Retractable Structures Comprised of Interlinked Panels."

BACKGROUND OF THE INVENTION

Structures that transform in size or shape have numerous applications in many fields. My prior patent, U.S. Pat. No. 5,024,031, hereby incorporated by reference as if fully disclosed herein, teaches methods for constructing transformable truss-structures in a variety of shapes. The teachings therein have been used to build structures for diverse applications including architectural uses, public exhibits and educational toys.

One particular embodiment disclosed in U.S. Pat. No. 5,024,031 is a retractable structure that expands from a compact ring of links to form a self-supporting structural dome. In its most basic embodiment, such a structure is made entirely of a latticework of links. The structure would be comprised of structural elements only, and the structural dome, when extended, retains a somewhat skeletal appearance. As an extension of that embodiment, a method was also disclosed to incorporate panel elements that may be attached to the outward side of structure, thereby creating a substantially smooth, continuous covering that covers the entire dome in its extended position (See FIGS. 28–33 of U.S. Patent No. 5,024,031).

Such an arrangement can be improved upon. Since the panel elements are separate pieces from the structural member themselves, they add additional elements that may negatively affect the structural integrity of the structure. Additional elements would also raise the cost to build and maintain such a structure. A further concern is that when building a large structure, the panel elements may catch the wind and cause them to be dislodged from the structural elements.

BRIEF SUMMARY OF THE INVENTION

In accordance with the present invention, a retractable structure is presented that incorporates an additional useful feature. I have discovered a way to construct such retractable structures whereby the links are themselves panel elements. Thus, the structural members themselves form a continuous surface, leading to a more economical, structurally sound and cleaner design.

Such links can be assembled to form planer and three-dimensional structures. In their planar embodiments, retractable structures according to this invention may be comprised exclusively of panels hinged together. In their three-dimensional embodiments, whether conical, hemispherical or other shapes, panels are connected to one another via small hub elements.

This discovery represents a significant improvement over the earlier invention, and offers the promise of building of practical architectural structures with retractable features.

BRIEF DESCRIPTION OF THE DRAWINGS

FIG. 25 shows a perspective view of a retractable domed structure in its extended position.

FIG. 26 shows an elevation view of the domed structure.

FIGS. 27 and 28 show the same retractable dome in its partially retracted and fully retracted positions respectively.

FIG. 29 shows a panel-link that is constructed of a frame with a sheet material to provide an infill, along with a linear link.

FIG. 30 shows a tongs linkage in its extended position, whereby the linkage is comprised of four panel-links and four linear links.

FIG. 31 shows the tongs linkage in a partially retracted position, the slide elements having moved along the supporting structure.

FIG. 32 shows the tongs linkage in its fully retracted position so that it is fully retracted to within the supporting structure.

DETAILED DESCRIPTION OF THE INVENTION

Figures 1, 2, 3, 4, 5, 6, 7:
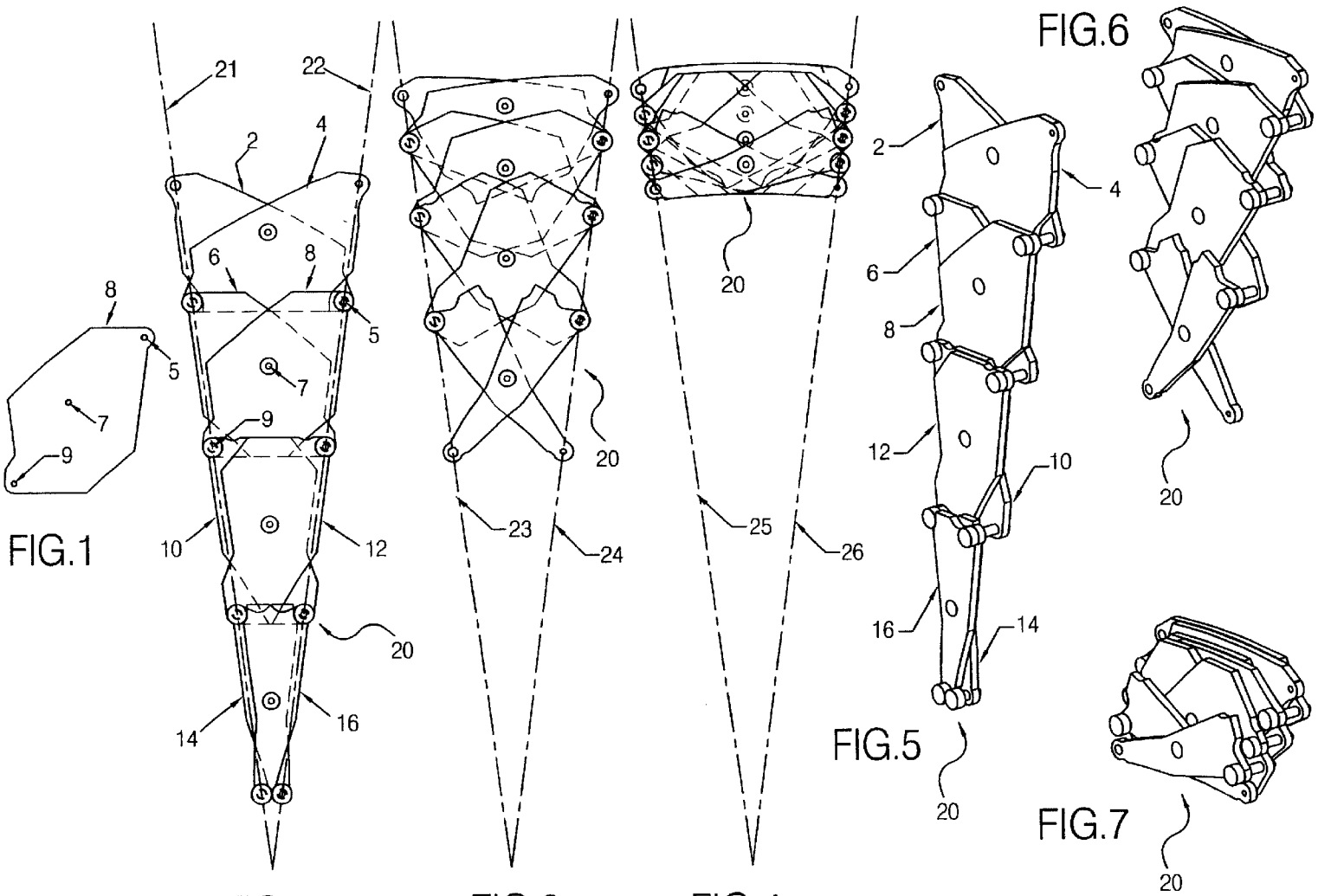
FIG. 1 shows a typical panel-link with three pivot points.
FIG. 2 shows a tongs linkage comprised of eight separate panel-links in its extended position, forming a wedge-shaped surface.
FIG. 3 shows the same linkage in a partially retracted position, its edges lying along the lines of a similar angle to that in FIG. 1.
FIG. 4 shows the same linkage in a fully retracted position, its edges lying along the lines of a similar angle to that in FIG. 1.
FIGS. 5, 6, and 7 show perspective views of the same linkage in its extended, partially retracted and fully retracted positions respectively.

In FIG. 1 is shown a typical panel-link element 8 which has a polygonal profile. Panel link element 8 has one central pivot 7 and two end-pivots 5 and 9. A single panel-link element is the most basic element in the structure. Two panel-link elements can be pivotally connected to each other by their central pivots to form a link-pair.

A plurality of these link-pairs can be pivotally connected to each other by their end-pivots to form a structure that can extend like a pair of extendable tongs (hence, a "tongs linkage"). FIG. 2 shows such a tongs linkage 20 which is comprised of eight panel-links 2, 4, 6, 8, 10, 12, 14 and 16. Links 6 and 8 are pivotally joined together via pivot 7 to form a link-pair. Similarly links 2 and 4 are joined, as are links 10 and 12, as are links 14 and 16. Each link-pair is itself joined to a neighboring pair via two pivots. Linkage 20 is shown in an extended position whereby a triangle-shaped surface is formed. A line 22 passes through one end-pivot each of all of the panel-links. A second line 21 passes through the other end-pivot of the panel-links.

In FIG. 3 linkage 20 is shown in a partially retracted position. A line 23 passes through one end-pivot each of the eight panel-links and a second line 24 passes through the other end-pivot. The angle formed between lines 23 and 24 is identical to the angle formed between lines 21 and 22.

In FIG. 4 linkage 20 is shown in a fully retracted position. A line 25 passes through one end-pivot each of the eight panel-links and a second line 26 passes through the other end-pivot. The angle formed between lines 25 and 26 is identical to the angle formed between lines 21 and 22.

FIG. 5 shows a perspective view of linkage 20 in an extended position. Link-pair 14,16 lies in an offset plane from link-pair 10,12 which itself lies in an offset plane from link-pair 6,8. This last link-pair is itself offset from link-pair 2,4. FIG. 6 shows a perspective view of linkage 20 in a partially retracted position. The offsets between adjacent link-pairs allow them to slide over one another without interference. FIG. 7 shows linkage 20 in its fully retracted position whereby all of the panel-links are stacked over one another.

Figures 8, 9, 10, 11, 12:
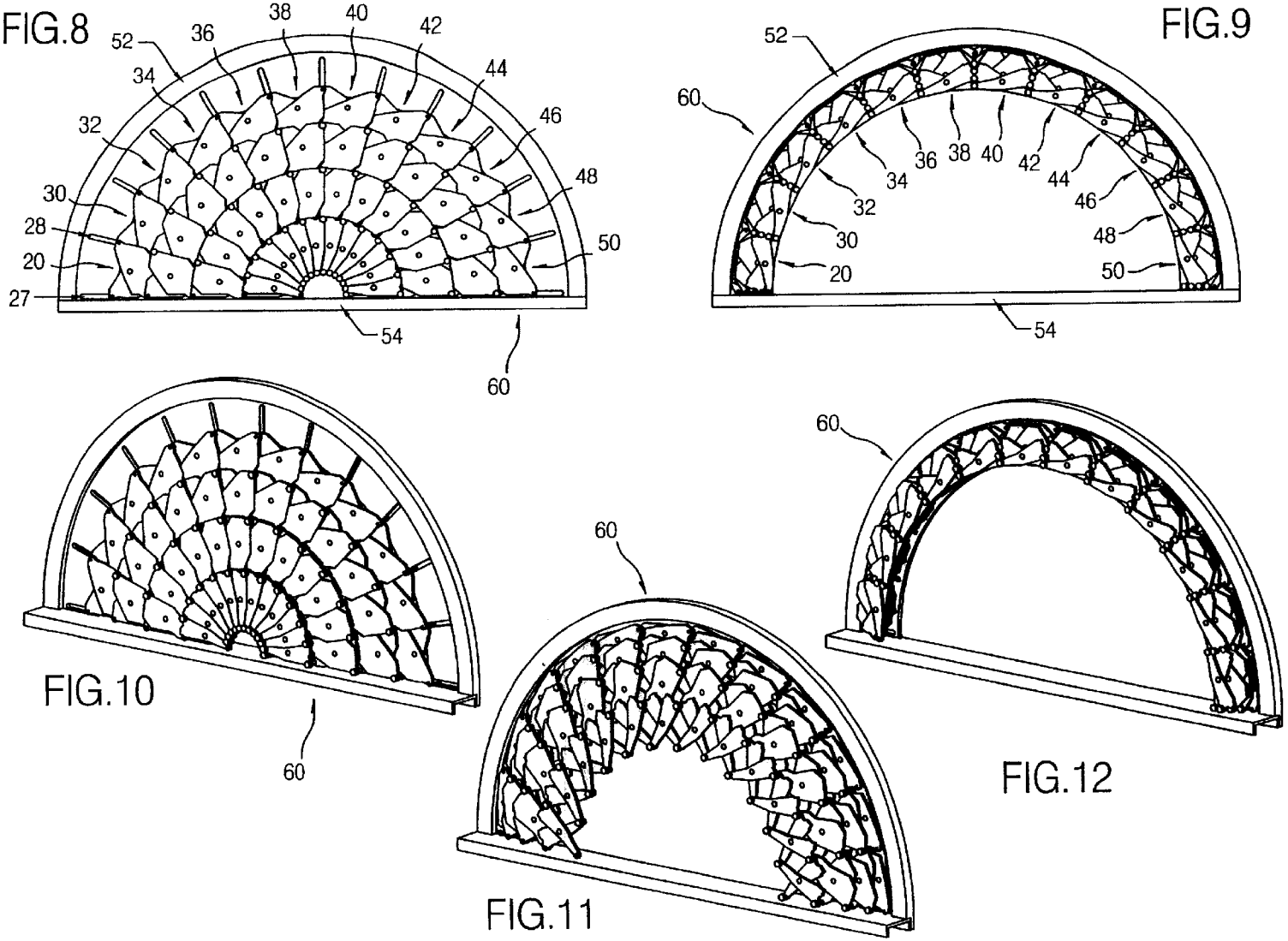
FIG. 8 shows a structural arch to which twelve extended tongs-linkages have been attached, said linkages also being joined to one another, to form a semi-circular planar surface.
FIG. 9 shows the same structure wherein all twelve tongs-linkages have been fully retracted into the structural arch, thereby providing a large semi-circular opening.
FIG. 10 shows a perspective view of the planar arch structure in its extended position.
FIGS. 11 and 12 show perspective views of the planar arch structure in its partially retracted and fully retracted positions respectively.

FIG. 8 shows a semi-circular retractable structure 60 which is comprised of 12 tongs-linkages 20,30,32,34,36,38, 40,42,44,46,48 and 50 each one of which is pivotally joined to its neighboring linkage via those end pivots which lie in along a line. Shown in its extended position, structure 60 forms a semi-circular solid wall. Structure 60 is further comprised of a stationary arch 52 which supports the linkages. Linkage 20 is attached to arch 52 via two sliding connections 27 and 28. Similarly all of the remaining linkages are attached to arch 52 by sliding connections. Structure 60 is further comprised of a linear track 60 which supports tongs linkages 20 and 50 along their unattached edges. FIG. 9 shows structure 60 in its fully retracted position whereby the linkages have retracted to overlap arch 52 thereby providing a semi-circular opening. FIGS. 10, 11 and 12 shows perspective views of structure 60 in its extended, partially retracted and fully retracted positions respectively.

Figure 14:
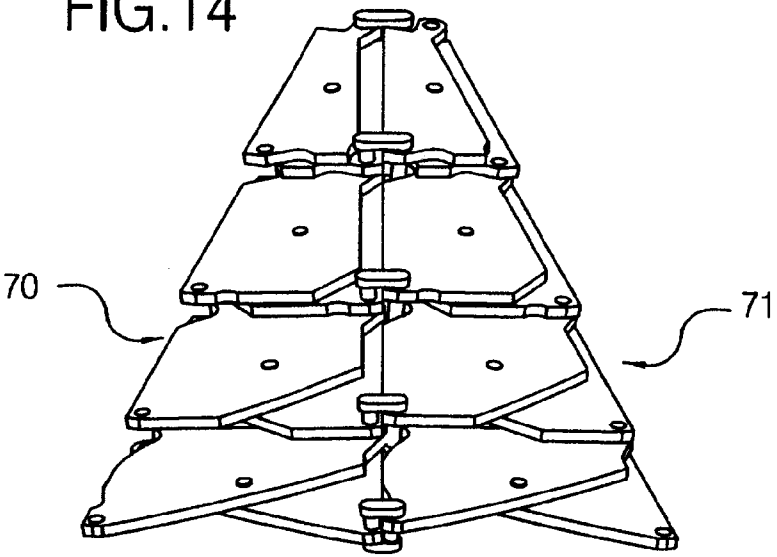
FIG. 14 shows same two linkages joined together by the hub elements.
Figure 15:
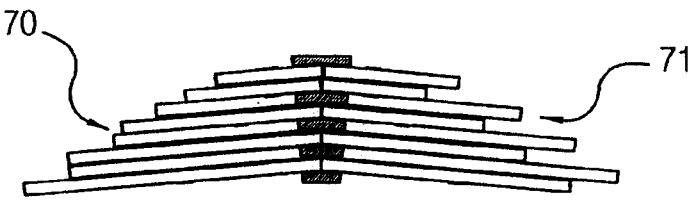
FIG. 15 shows a sectional view revealing an angled relationship between the two linkages.
Figure 13:
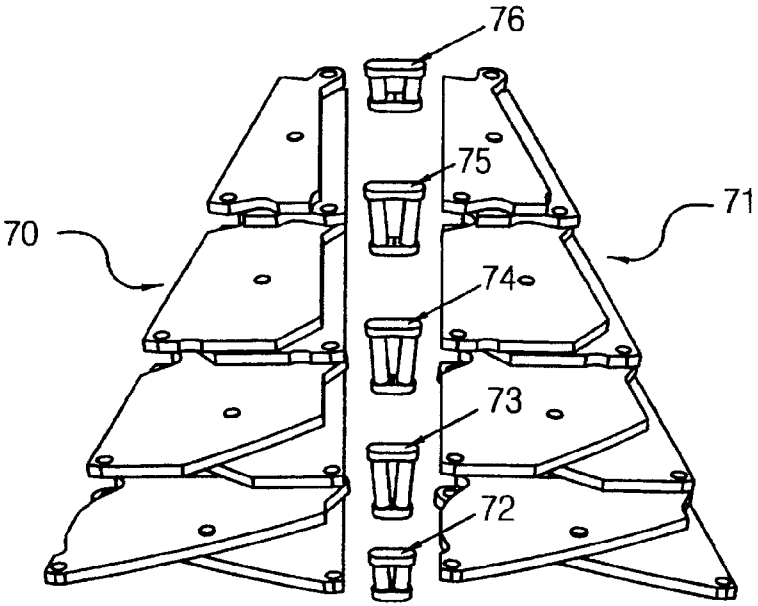
FIG. 13 shows two planar tongs-linkages about to be joined to one another by six hub elements.
Figure 16:
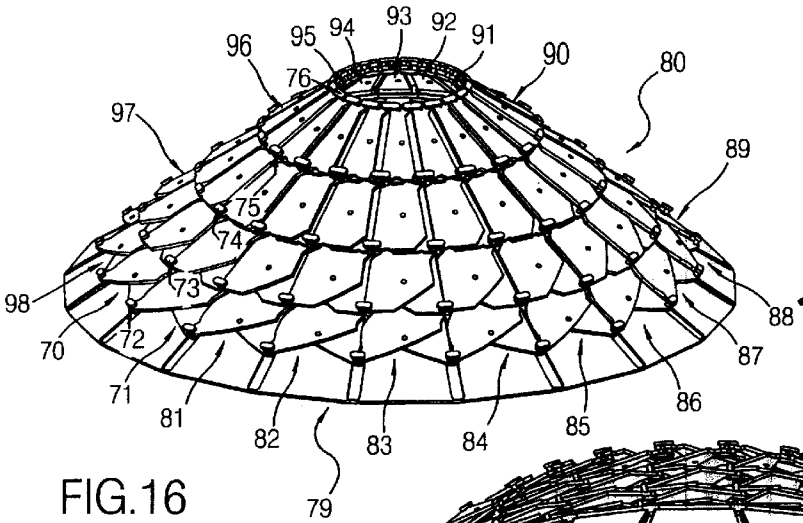
FIG. 16 shows a perspective view of a retractable conical structure comprised of twenty planar tongs-linkages, shown here in its extended position, each linkage being joined to one another by hub elements, thereby forming a complete ring.

FIG. 13 shows two tongs-linkages 70 and 71 in proximity to five hub elements 72, 73, 74, 75 and 76. FIG. 14 shows linkages 70 and 71 joined to one another via those same five hub elements. FIG. 15 shows a sectional view of the joined tongs-linkages revealing an angular relationship between them, said angle being formed by the hub elements. FIG. 16 shows a retractable structure 80 having a conical form which is comprised of twenty tongs linkages 70, 71 and 81 through 98 (consecutively). Each tongs linkage is connected to two of its neighboring linkages via adjoining hub elements. For example linkage 70 is joined to linkage 71 via hub elements 72,73,74,75 and 76. Structure 80 is further comprised of a base support 79. Each tongs linkage is joined to base support 79 via two sliding connections.

Figure 17:
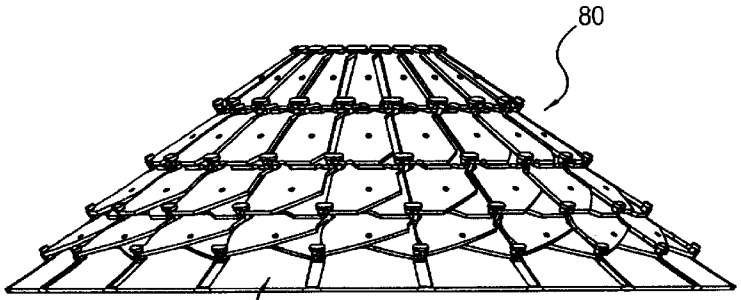
FIG. 17 shows the same structure in elevation view.
Figure 18:
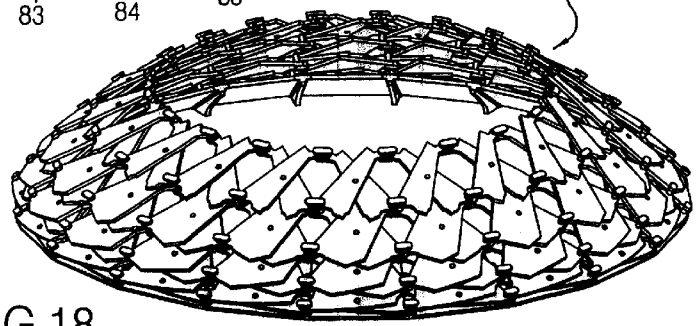
FIGS. 18 and 19 show perspective views of the same structure in its partially retracted and fully retracted positions.
Figure 19:
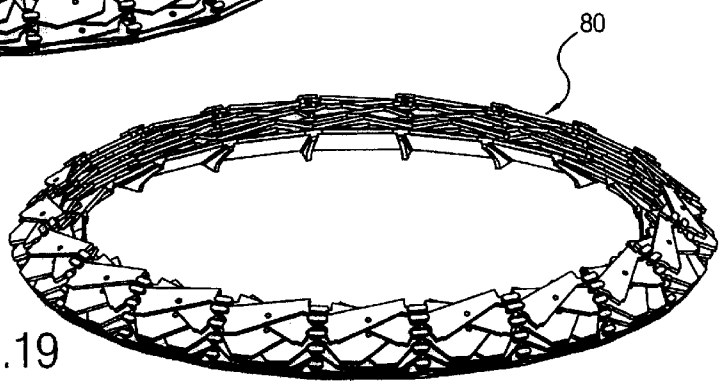

FIG. 17 shows an elevation view of structure 80. FIG. 18 shows a perspective view of structure 80 in a partially retracted position. FIG. 19 shows structure 80 in a fully retracted position.

Figure 22:
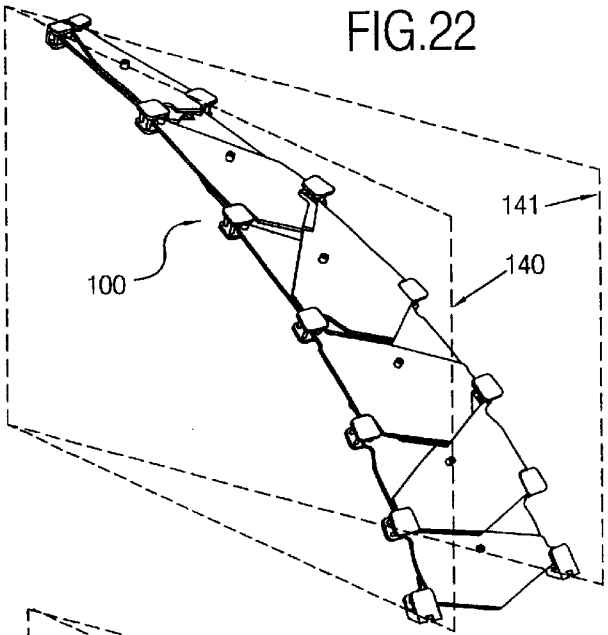
FIGS. 22, 23 and 24 show perspective views of the curved tongs-linkage in its extended, partially retracted and fully retracted states respectively.
Figure 20:
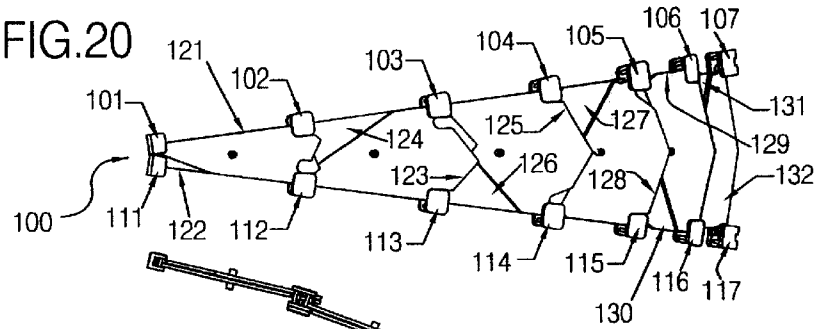
FIG. 20 shows a plan view of a curved tongs-linkage in its extended position.
Figure 21:
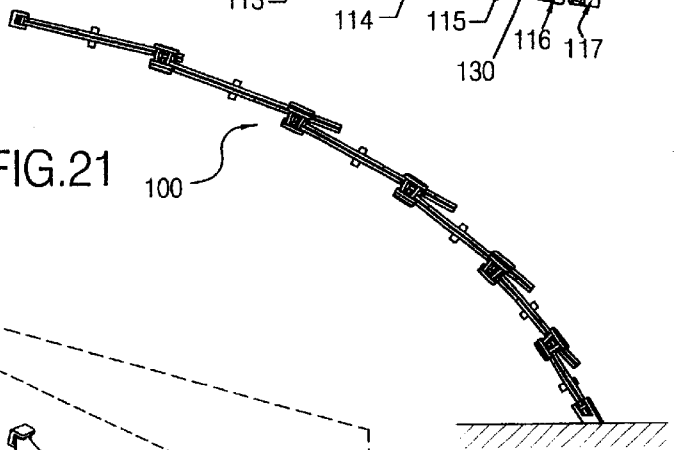
FIG. 21 shows an elevation view of the same linkage.

FIG. 20 shows a tongs linkage 100 which is comprised of twelve panel-links and 14 hub elements. Linkage 100 is shown in its extended position forming a continuous triangular shaped surface. Link-pair 121,122 is joined to link-pair 123,124 via hub elements 102,112. Link-pair 123,124 is joined in turn to link-pair 125,126 via hub elements 103,113. Similarly each successive link-pair is joined to its neighboring pair by a pair of hub elements. Linkage 100 is shown in elevation view in FIG. 21. It may be seen to have a curved profile, this curvature being introduced by the various hub elements. FIG. 22 shows a perspective view of linkage 100 in its extended position. The edges of the panel-links may be seen to lie in planes 140 and 141. Likewise, the center-planes of the hub elements lie in planes 140 and 141.

Figure 24:
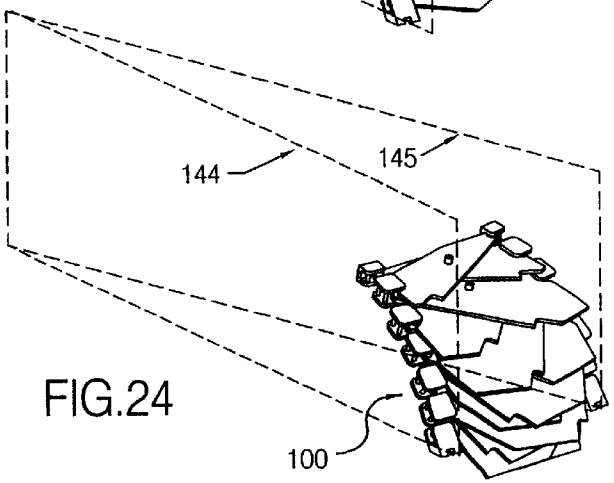
Figure 23:
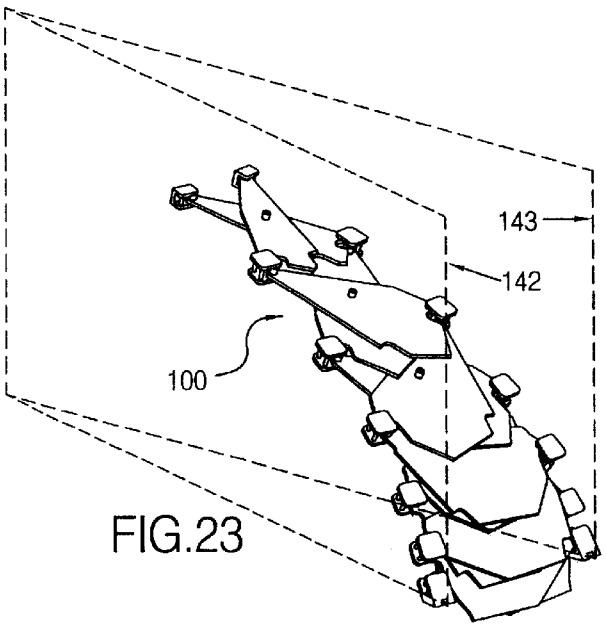

FIG. 23 shows linkage 100 in a partially retracted position. The center-planes of the hub elements lie in planes 142 and 143. The angle formed between planes 142,143 is identical to the angle formed between 140, 141. FIG. 24 shows linkage 100 in its fully retracted position. The center-planes of the hub elements lie in planes 144 and 145. The angle formed between planes 144,145 is identical to the angle formed between 140,141. FIG. 25 shows a retractable structure 110, which is a dome, in its fully extended position. Structure 110 is comprised of 24 linkages which are similar to linkage 100, each linkage being connected to its neighbor by adjoining hub elements. Structure 110 is supported by a base 115 to which each of the 24 linkages are attached by sliding connections.

FIG. 26 shows structure 110 in elevation view. FIGS. 27 and 28 show structure 110 in its partially retracted and fully retracted positions respectively.

FIG. 29 shows panel-link 123 that is constructed of framing elements 140 that connect the three pivots, and border the polygonal profile. Link 123 is further comprised of an infill 141 which is a sheet material attached to frame 140. Also shown in FIG. 29 is a linear link 124 which has three pivots.

FIG. 30 shows a tongs linkage in its extended position, whereby the linkage is comprised of four panel-links and four linear links. Link-pairs are made up of one panel-link and one linear link respectively. For example panel-link 123 is joined to linear link 124 by their central pivots. In its extended position the four panel-links form a triangular-shaped surface that is one layer thick. The linear links serve to synchronize the motion of the linkage, but do not provide covering themselves. Also shown in FIG. 30 is a stationary supporting structure 134 to which two links 127 and 128 are joined via slide elements 130 and 132 respectively.

Figure 33:
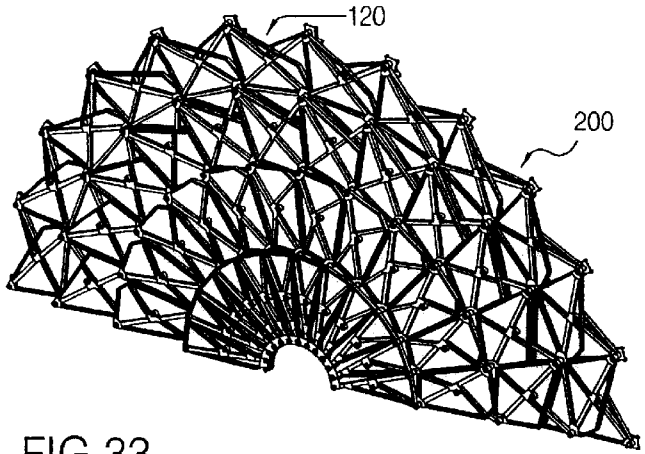
FIG. 33 shows a semi-circular retractable structure consisting of twelve tongs linkages.

FIG. 31 shows the tongs linkage in a partially retracted position, the slide elements having moved along the supporting structure. FIG. 32 shows the tongs linkage in its fully retracted position so that it is fully retracted to within the supporting structure. FIG. 33 shows a retractable structure 100 consisting of twelve tongs linkages which are attached to one another by their end pivots. Structure 200 is shown in its extended position whereby a continuous surface is formed having a semi-circular profile.

Figure 34:
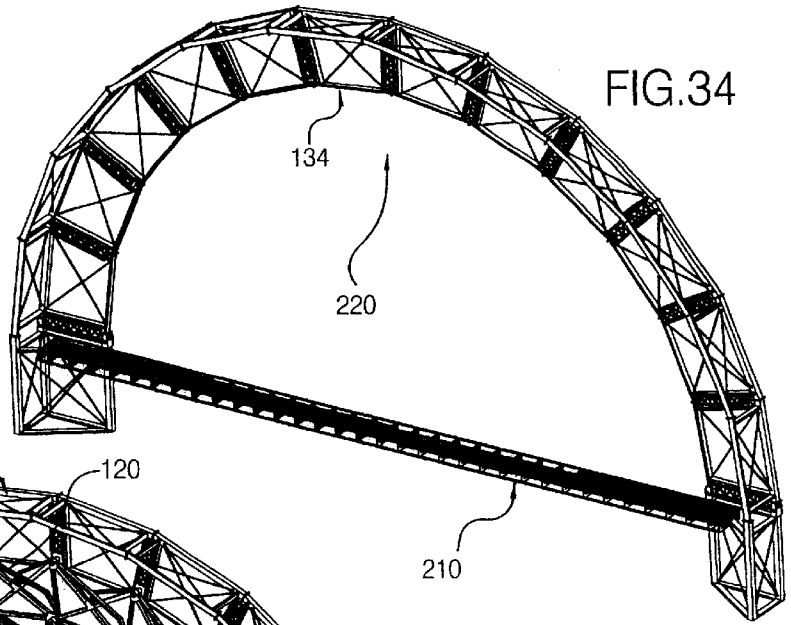
FIG. 34 shows a stationary supporting arch and a supporting track.
Figure 35:
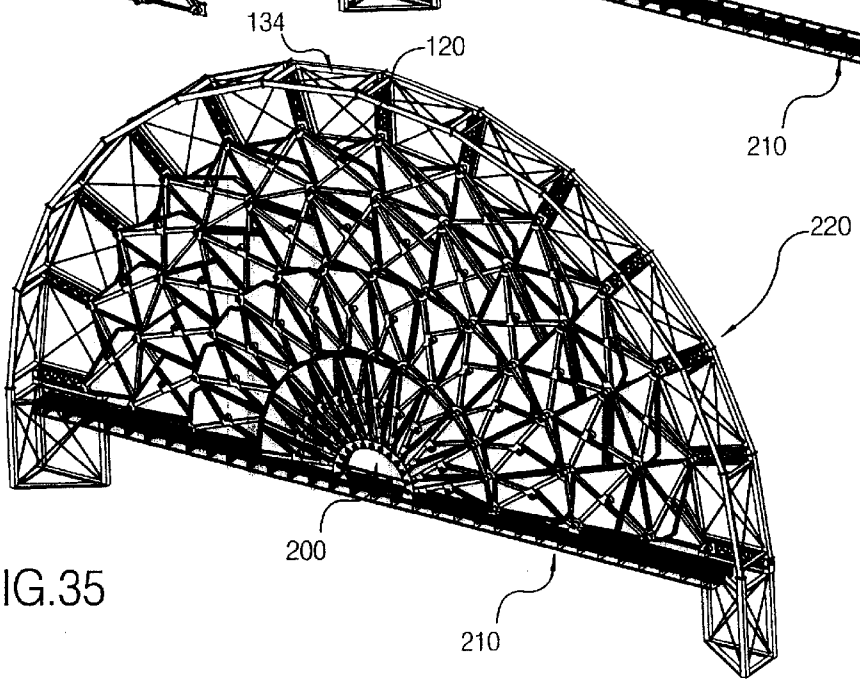
FIG. 35 shows the retractable structure and supporting structure together.

FIG. 34 shows a stationary supporting arch 220 and a supporting track 210. FIG. 35 shows the retractable structure 200 attached to supporting structure 220 by a series of slide connections. Track 210 supports the edges of those linkages that lie on the border of the semi-circle.

Figure 37:
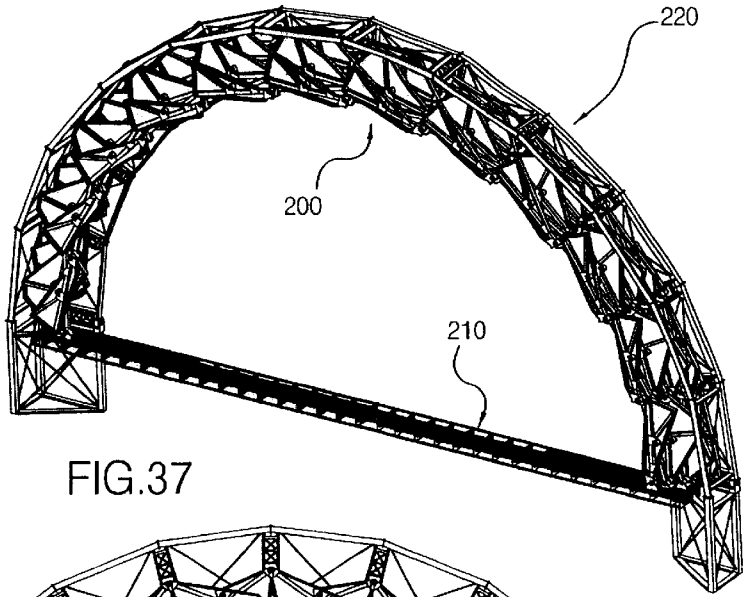
FIGS. 36 and 37 show the structure in its partially extended and fully retracted position respectively.
Figure 36:
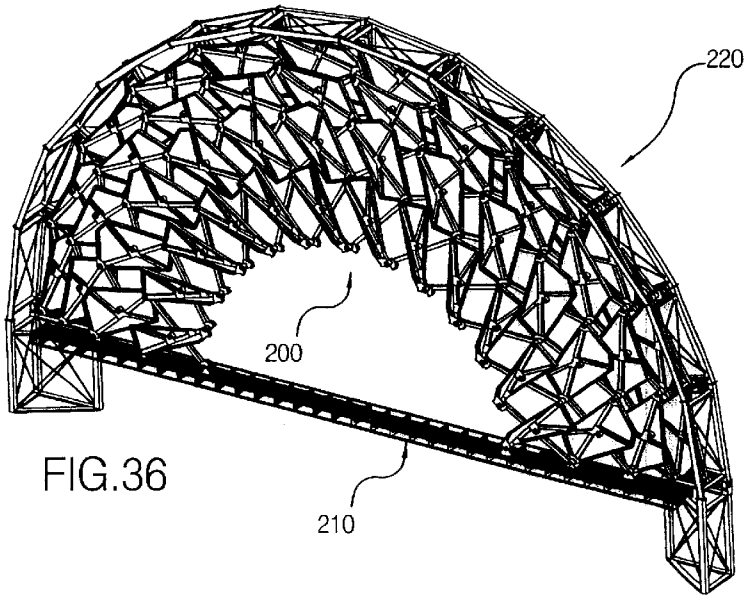
Figure 38:
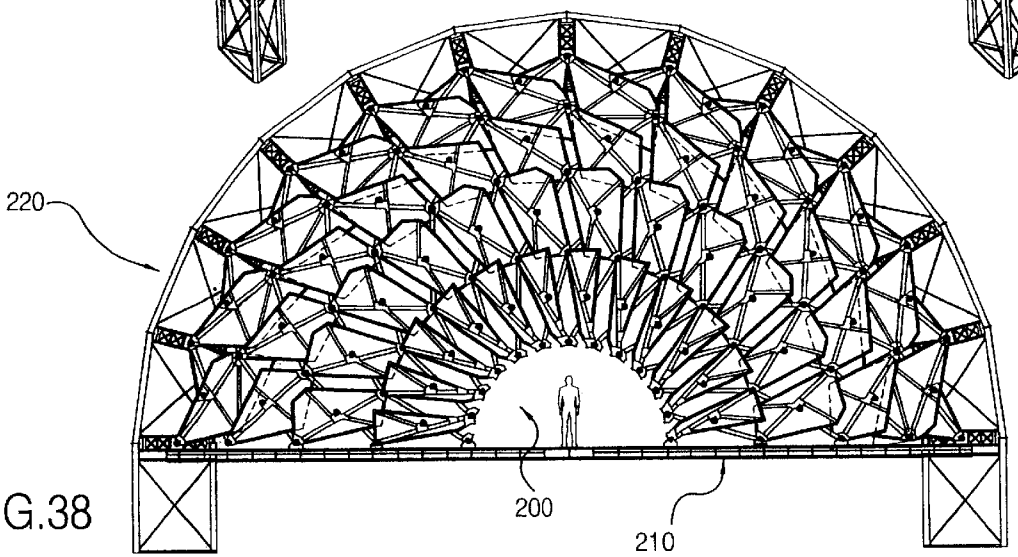
FIG. 38 shows an elevation view of the same retractable structure.

FIGS. 36 and 37 show the structure 200 in its partially extended and fully retracted position respectively. Finally, FIG. 38 shows an elevation view of the retractable structure 200.

It will be appreciated that the instant specification, drawings and claims set forth by way of illustration and not limitation, and that various modification and changes may be made without departing from the spirit and scope of the present invention.

What is claimed is:

1. A retractable structure comprising a plurality of linkages, each of said linkages comprising a plurality of link-pairs, each of said link-pairs comprising two panel-links, each of said panel-links having a polygonal profile and at least three pivots, one central pivot and at least two end pivots, wherein each panel-link is joined to the other panel-link of its link-pair by their central pivots, and each link-pair is joined to one or more neighboring link-pairs by two end pivots, each link-pair lying in a different plane than its neighboring pair, whereby in its extended position the polygonal profiles of the panel-links overlap so that a continuous triangle-shaped surface is formed, whereby each end pivot of every panel-link lies in one of two common planes with an angle formed between said planes, and that a tongs-linkage thus formed may be freely extended and retracted, so that for any position of the linkage, each end pivot continues to lie in one of two planes which form an angle between them, said angle being unchanged for any position.

2. A retractable structure according to claim 1, wherein the continuous triangle-shaped surface formed is curved in the third dimension.

3. A retractable structure according to claim 1, wherein the continuous triangle-shaped surface formed is essentially planar.

4. A retractable structure comprising two or more linkages according to claim 1, said linkages being joined directly to one another by two or more end pivots that lie in a common plane.

5. A retractable structure comprising two or more linkages according to claim 1, each linkage being joined by a multiplicity of end pivots to a multiplicity of hub elements which are in turn joined to the end pivots of a neighboring linkage.

6. A retractable structure comprising a multiplicity of linkages according to claim 1, that fills a semi-circular surface in its extended position.

7. A retractable structure according to claim 6, further comprising a stationary supporting arch which attaches to the retractable structure by two or more slide connections.

8. A retractable structure according to claim 4, said structure forming a surface of revolution in its extended position.

9. A retractable structure according to claim 6, further comprising a track bordering the base of the semi-circular surface which base forms a straight line along the track, which track supports the end pivots of the linkages that lie on the edge of the structure.

* * * * *